US007383959B1

(12) United States Patent
Rudd

(10) Patent No.: US 7,383,959 B1
(45) Date of Patent: Jun. 10, 2008

(54) BUNGEE CAROUSEL

(76) Inventor: R. Michael Rudd, 6867 Live Oak La., San Luis Obispo, CA (US) 93401

( * ) Notice: Subject to any disclaimer, the term of this patent is extended or adjusted under 35 U.S.C. 154(b) by 446 days.

(21) Appl. No.: 10/710,647

(22) Filed: Jul. 27, 2004

(51) Int. Cl.
*A47F 7/00* (2006.01)

(52) U.S. Cl. ..... 211/13.1

(58) Field of Classification Search ..... 211/13.1, 211/85.2, 85.7, 60.1, 61, 71.01, 72, 82.18, 211/86.01
See application file for complete search history.

(56) References Cited

U.S. PATENT DOCUMENTS 2,868,386 A * 1/1959 Seyforth ..... 211/95
3,739,919 A * 6/1973 Hochman ..... 248/220.43
4,012,915 A * 3/1977 Poma ..... 405/243
5,139,208 A * 8/1992 Schooley ..... 242/405.2
5,845,787 A * 12/1998 Dunnavant, Jr. ..... 211/13.1
6,099,060 A * 8/2000 Towers ..... 294/159
6,886,796 B1 * 5/2005 Elander ..... 248/339

* cited by examiner

*Primary Examiner*—Sarah Purol
(74) *Attorney, Agent, or Firm*—William Keyworth; Bill & Mary Lou Inc.

(57) ABSTRACT

A support and storage apparatus for elastic fastening devices, such as bungee cords, is configured to compactly store devices of various lengths in a convenient cylindrical carousel configuration. This configuration rotates to allow quick and easy identification and retrieval of an elastic fastening device of the desired length, and to allow quick and easy storage of the fastening device when the device is not in use. The apparatus may be hung in the horizontal position or mounted in a stand in a vertical or horizontal position to accommodate a variety of storage locations.

26 Claims, 4 Drawing Sheets

BUNGEE CAROUSEL

CROSS REFERENCE TO RELATED APPLICATIONS

Not Applicable.

FEDERAL RESEARCH STATEMENT

Not Applicable.

BACKGROUND OF INVENTION

1. Field of the Invention

This invention relates to a support and storage apparatus for maintaining elastic fastening devices, such as bungee cords, of various lengths on a frame single external surface, that may or may not rotate about an axis, to provide visual identification of available fastening device lengths and access to the desired device.

Typically such elastic fastening devices have means for attaching the device at the ends. The attachment means may be an attached hook, or the attachment means may be an enclosed opening on the ends with a hook that may be attached or detachable. Such elastic fastening devices are of various lengths to accommodate restraining materials of different sizes or quantities, and they are reusable, so it is desirable to store them between uses.

2. Description of Related Art

The use of storage apparatus for fastening devices is known in the prior art. A characteristic of fastening devices is the flexibility of the device provides a tendency, when not in use and stored with similar devices, to become a tangled mass. Such a tangled mass takes time to remove an individual fastener from the mass when desired to use it. Also it is difficult to determine the length of a particular fastener when in the tangled state.

Examples of prior art storage apparatus are U.S. Pat. No. 5,845,787 (Odunnavant, Jr.) and U.S. Pat. No. 6,099,060 (Towers). These storage apparatus make use of the fasteners attached to the ends of the fastening devices to maintain the fastener in a fixed position. U.S. Pat. No. 5,845,787 (Odunnavant, Jr.) attaches the fasteners in a U-shaped configuration on both sides of the center of a linear plane array using round dowel-like members on either side of a brace. The dowels and brace are fastened to support sides such that the configuration requires access to both sides of the linear plane array of fasteners to attach and disengage the storage device fastener. Also it is difficult to determine the length of a fastener attached to the apparatus, as the entire fastener is not visible in a single view. U.S. Pat. No. 6,099,060 (Towers) provides a linear plane array with multiple attachment cross arms intended to allow arranging the fasteners on one side or the other of the apparatus. This array however adds additional length to the apparatus. Both these apparatus require considerable storage room to accommodate the linear plane array of fasteners.

It is often desirable to store a set of fastening devices of various lengths in a portable manner for use in projects in the field, or projects in multiple locations. Storage in a truck bed, van interior, or hanging from the rack of a pickup truck or van interior is therefore desirable. The prior art takes up considerable space for such storage. What is needed is a compact storage apparatus for such use that provides ease of identifying the fastener length and provides ready access for installing or removing a fastener.

SUMMARY OF INVENTION

The present invention is a carousel storage apparatus for fastening devices. The fastening devices are stored on a cylindrical bungee tube exterior surface with multiple attachment openings arranged through the tube from the exterior to the interior surface. The bungee carousel takes advantage of the fastening devices elasticity to maintain the devices on the carousel. The cylindrical configuration provides a compact storage arrangement that may be rotated by hand for inspecting the fastening devices, and is convenient for installing or removing a fastening device.

The bungee tube attachment openings are arranged such that many fastening devices of varying lengths may be removably installed on the bungee tube between the attachment openings, and other fastening devices may be removably installed between an attachment opening and a bungee tube end opening.

The bungee tube may incorporate an axle upon which the bungee tube is mounted. The tube is attached to, or incorporates, one or more axle brackets, and a tubular axle is arranged through an opening in the axle brackets forming a bearing surface. The bearing surface is sized such that the bungee tube may be rotated about the tubular axle. Two axle bracket spacers are arranged at each end around the tubular axle between the axle bracket and an axle cap fastened to the tubular axle. The axle bracket spacers maintain axial alignment of the bungee tube with the axle. The axle caps may have a hanger for hanging the storage apparatus by the axle cap, or the storage apparatus may be vertically mounted in a stand.

OBJECTS AND ADVANTAGES

One object of this invention is to provide a compact storage apparatus for fastening devices.

A second object of this invention is to provide a storage apparatus for fastening devices that provides easy visual identification of the fastening devices.

A third object of this invention is to provide a storage apparatus for fastening devices that provides ease of installation and removal of the fastening device.

A fourth object of this invention is to provide a storage apparatus for fastening devices that is economical to manufacture.

BRIEF DESCRIPTION OF DRAWINGS

A more complete understanding of the present invention can be obtained by considering the detailed description in conjunction with the accompanying drawings, in which.

Reference Numerals in Drawings

Figure 1:
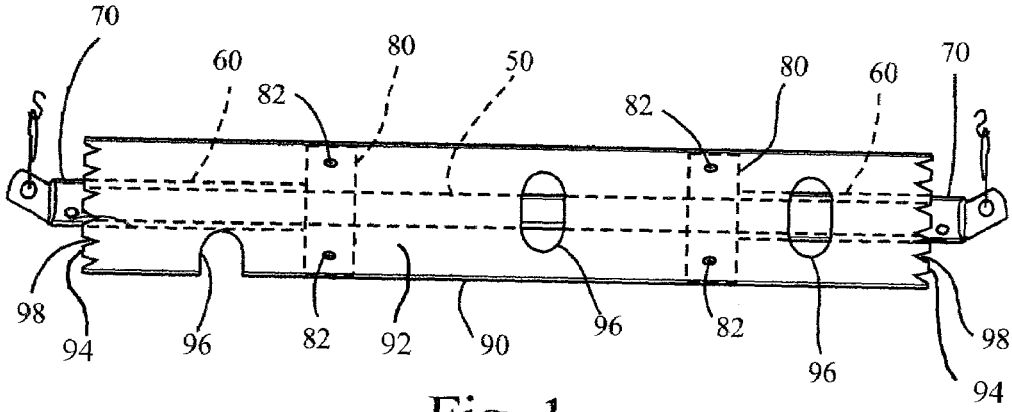
FIG. 1 is a side view of a bungee carousel mounted on an axle showing in hidden lines the interior structure for the axle.

These reference numbers are used in the drawing to refer to areas or features of the invention.

50 Tubular axle.
60 Axle bracket spacer
70 Axle cap
72 Axle cap closed end
74 Axle cap support end
80 Axle bracket
82 Axle bracket attachment fastener
84 Axle bracket interior side
86 Axle bracket external side
88 Axle bracket bearing surface
90 Bungee tube
92 Bungee tube exterior surface
94 Bungee tube end opening
96 Bungee tube attachment opening
98 Bungee tube end opening notch
100 Bungee tube attachment opening notch
120 Vertical mounting stand

DETAILED DESCRIPTION

Figure 2:
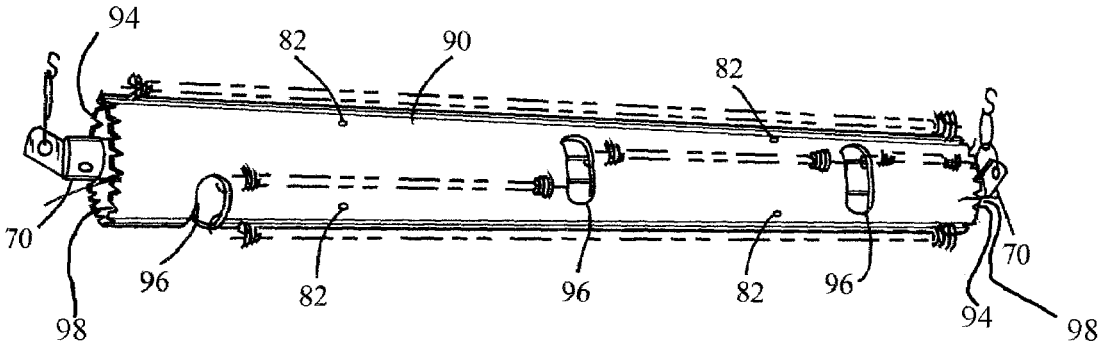
FIG. 2 is a perspective view of a bungee carousel mounted on an axle showing fastening devices of various lengths, drawn in dashed lines, installed on the carousel.
Figure 3:
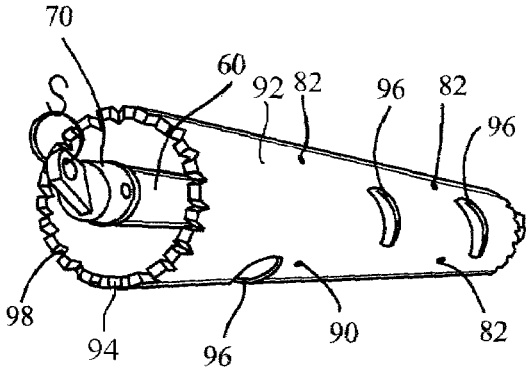
FIG. 3 is a perspective view of a bungee carousel mounted on an axle with a view into the interior of one end.
Figure 4:
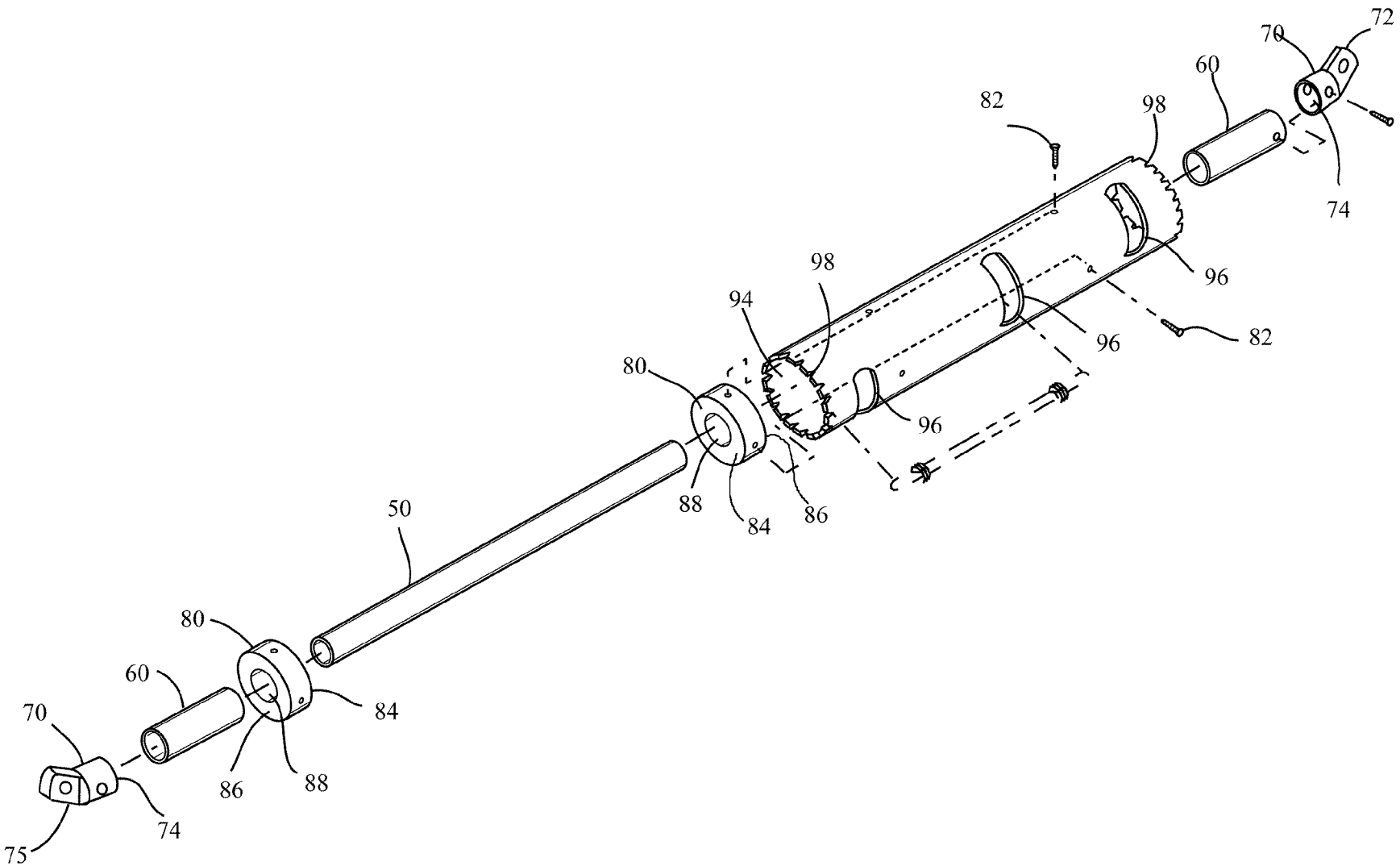
FIG. 4 is an exploded view of a bungee carousel with an axle mounting. A representative fastening device is shown, drawn in dashed lines.
Figure 5:
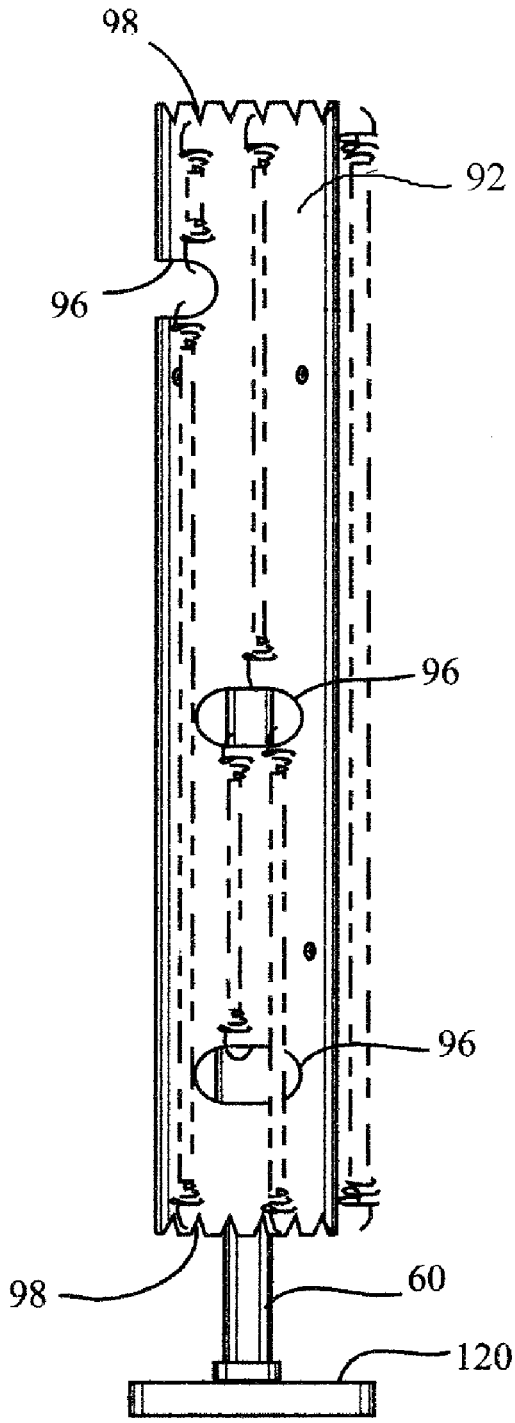
FIG. 5 is a side view of a bungee carousel mounted vertically on an axle showing fastening devices of various lengths, drawn in dashed lines, installed on the carousel.

The bungee carousel is a compact storage apparatus for elastic fastening devices as shown in FIGS. 1 through 7. Typically such elastic fastening devices have means for attaching the device at the ends. The attachment means may be an attached hook, such as is shown in FIGS. 2, 4, and 5, or the attachment means may be an enclosed opening on the ends with a hook that may be attached or detachable. Such elastic fastening devices are made in various lengths to accommodate restraining materials of different sizes or quantities, and they are reusable, so it is desirable to store them between uses. FIGS. 2 and 5 show the storage of fastening devices of differing lengths. The storage takes advantage of the elastic nature of the fastening device by stretching it to engage the hooks on the bungee carousel, leaving the fastening device in a slightly tensioned condition, and allowing removal of the fastener by again stretching the fastening device to remove the hooks from the bungee carousel.

The fastening device storage is on a bungee tube (90) as shown in FIGS. 1, 2, 5, 6, and 7. The fastening devices are attached to the bungee tube by attaching their hooks to the bungee tube end openings (94), by attaching their hooks to one bungee tube end opening (94) and a bungee tube attachment opening (96), or by attaching their hooks to two bungee tube attachment openings (96). These storage options are available at multiple locations around the circumference of the bungee tube exterior surface (92) as shown in FIG. 2.

The bungee tube may be rotated by turning the tube by hand in order to make the entire circumference of the tube visible and accessible. The rotation of the bungee tube alternately may be on an axis determined by an axle (50) positioned within the bungee tube opening (94) by two or more axle brackets (80) located in, and attached to, the bungee tube as shown in FIG. 1. The axle brackets are attached to the bungee tube by fasteners (82), such as indicated in FIG. 4, or may be formed integral with the tube. The axle is positioned within the axle bracket bearing surface (88) as shown in FIGS. 1 and 4. This positioning allows rotation of the bungee tube and attached axle bracket around the axis of the axle.

The alignment of the axle within the length of the bungee tube is set by axle bracket spacers (60) that slip over the axles (50). The axle bracket spacers (60) are sized to bear on the axle bracket external surface (86) and not enter the axle bracket bearing surface (88). The axle bracket spacers (60) slip over the axle and bear upon the axle bracket external side (86). Alternately they may be formed integral with the axle brackets. Two axle caps (70) are inserted over the axles at the attachment ends (74) and are fastened to the ends of the axle after installation of the axle bracket spacers (60). This retains the spacers and set the location of the axle within the length of the bungee tube. The axle caps may have means for hanging the apparatus on the axle cap closed end (72) as shown in FIGS. 1, 2, 3, and 4. Alternately it may be mounted in a stand (120) as shown in FIG. 5 to accommodate the users available storage space.

The apparatus is made of various readily available piping or other tubular products, and common attachments or accessories for tubular products. Some parts may be custom manufactured to effect lower costs or desired appearance enhancements, such as colors other than white, gray, or black. The bungee carousel is economically manufactured by selecting a length for the bungee tube to accommodate the longest elastic fastening devices to be installed on the apparatus, and forming multiple attachment openings to accommodate the various lengths of shorter elastic fastening devices. If desired to mount the bungee carousel, the axle brackets are then installed internal to the bungee tube, and an axle of the proper length is installed within the axle bracket bearing surfaces. The axle length is selected based on the length of the axle bungee tube and allowing for extension beyond the tube for installation of the axle bracket spacers and axle caps. The axle bracket spacer length is selected based on the position of the axle bracket spacers within the bungee tube. Axle caps are then installed on both ends of the axle, or alternately if a stand is to be used the stand is attached to one end of the axle. The apparatus may then be supported and positioned horizontally by hanging it from the axle caps or alternately supported and positioned vertically by the stand.

Alternate Embodiments

One embodiment of the bungee carousel is to provide bungee tube end opening notches (98) as shown on the figures. These notches retard motion of the elastic fastening devices around the circumference of the bungee tube to maintain the devices in a more orderly storage configuration.

Figure 6:
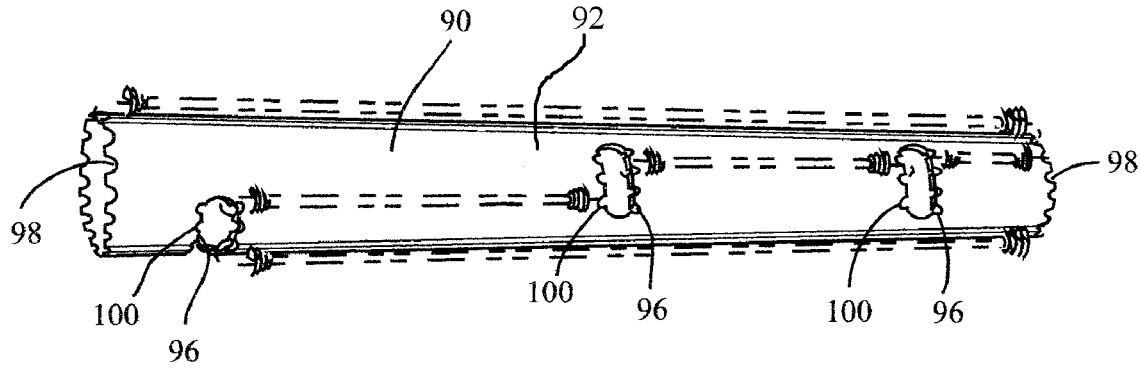
FIG. 6 is a perspective view of a bungee carousel bungee tube with no mounting in an embodiment with notched attachment openings showing fastening devices of various lengths, drawn in dashed lines, installed on the carousel.
Figure 7:
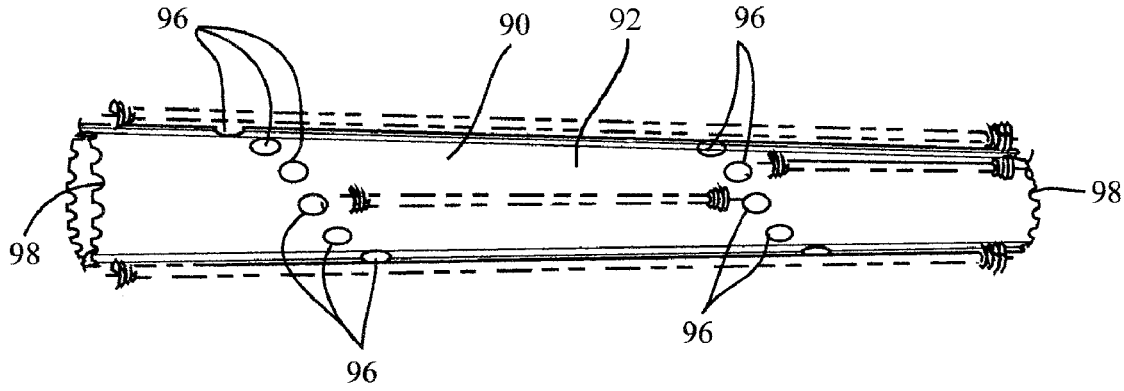
FIG. 7 is a perspective view of a bungee carousel bungee tube with no mounting in an embodiment with small attachment openings showing fastening devices of various lengths, drawn in dashed lines, installed on the carousel.

A second embodiment of the bungee carousel is to provide attachment opening notches (100) as shown on FIG. 6. These notches retard motion of the elastic fastening devices around the circumference of the bungee tube to maintain the devices in a more orderly storage configuration.

A third embodiment of the bungee carousel is to reduce the size of the attachment openings as shown in FIG. 6. This accommodates a larger variety of elastic fastening device lengths and also assists in maintaining the devices in an orderly storage configuration.

A fourth embodiment of the bungee carousel is to attach the stand to a vertical surface such that the stand supports and positions the bungee carousel in a horizontal position.

Operation

Elastic fastening devices are stored and retrieved using the bungee carousel by rotating the bungee tube such that an attachment opening is in view that is arranged so the elastic fastening device of interest may be stretched in locations between two attachment openings, or between an attachment opening and a bungee tube end, or between the bungee tube ends. Then the fastening device attachment hoods are attached to the bungee tube in the desired location. This is repeated for each elastic fastening device desired to be stored on the apparatus. The stored elastic fastening devices are then in a compact and visible storage configuration.

Retrieval of a desired elastic fastening device is by rotating the bungee tube to inspect the lengths of the fastening devices, and selecting a desired fastening device length. The desired elastic fastening device is stretched to disengage the fastening device from the bungee tube.

I claim:

1. A storage apparatus for elastic fastening devices comprising:

a. a bungee tube with a first end and a second end and an exterior surface and an interior surface, the first end and second end containing an end opening, the surfaces containing a multiplicity of attachment openings arranged to removably install multiple fastening devices and extending through the tube from the exterior to the interior surface; and b. the bungee tube attachment openings arranged such that a multiplicity of fastening devices of varying lengths are removably installed on the tube exterior surface between bungee tube ends, between bungee tube openings and a bungee tube end, and between bungee tube openings, wherein the bungee tube may be rotated to a position allowing identifying and attachment or removal of a fastening device of desired length.

2. The storage apparatus for fastening devices as in claim 1 further comprising the bungee tube ends contain a multiplicity of notches arranged such that the stored fastening device is constrained from motion relative to the bungee tube outer surface circumference by the notch.

3. The storage apparatus for fastening devices as in claim 1 further comprising the bungee tube attachment openings contain a multiplicity of notches arranged such that the stored fastening device is constrained from motion relative to the bungee tube outer surface circumference by the notch.

4. The storage apparatus for fastening devices as in claim 2 further comprising the bungee tube attachment openings are arranged such that the stored fastening device is constrained from motion relative to the bungee tube outer surface circumference by the bungee tube attachment opening size.

5. The storage apparatus for fastening devices as in claim 1 further comprising:

a. one or more axle brackets with an interior side, an exterior side, and a continuous opening between the interior and exterior sides such that the opening forms an axle bracket bearing surface, the axle bracket arranged within the bungee tube end openings such that the axle bracket is connected to the bungee tube interior surface;

b. a tubular axle with a first end and a second end arranged such that the tubular axle may be inserted through the axle bracket bearing surface such that the axle bracket bearing surface may be rotated about the tubular axle wherein the connected bungee tube is also rotated about the tubular axle;

c. two axle bracket spacers with a first end and a second end and an inner surface and an outer surface, the ends containing an end opening continuous from the first end to the second end, the openings arranged such that the tubular axle may be inserted into the opening;

d. two axle caps with an attachment end and a closed end, the attachment end with an internal opening from the attachment end partially to the hanger end and arranged such that the tubular axle may be inserted in the attachment end internal opening, the attachment end further arranged with means for fastening the axle cap to the inserted tubular axle; and e. the axle bracket spacers first and second ends arranged such that the axle bracket spacer first end is adjacent to an axle cap and the axle bracket spacer second end is adjacent to an axle bracket exterior side wherein the axle bracket spacer retains the bungee tube in axial alignment with the tubular axle.

6. The storage apparatus for fastening devices as in claim 2 further comprising:

a. one or more axle brackets with an interior side, an exterior side, and a continuous opening between the interior and exterior sides such that the opening forms an axle bracket bearing surface, the axle bracket arranged within the bungee tube end openings such that the axle bracket is connected to the bungee tube interior surface;

b. a tubular axle with a first end and a second end arranged such that the tubular axle may be inserted through the axle bracket bearing surface such that the axle bracket bearing surface may be rotated about the tubular axle wherein the connected bungee tube is also rotated about the tubular axle;

c. two axle bracket spacers with a first end and a second end and an inner surface and an outer surface, the ends containing an end opening continuous from the first end to the second end, the openings arranged such that the tubular axle may be inserted into the opening;

d. two axle caps with an attachment end and a closed end, the attachment end with an internal opening from the attachment end partially to the hanger end and arranged such that the tubular axle may be inserted in the attachment end internal opening, the attachment end further arranged with means for fastening the axle cap to the inserted tubular axle; and e. the axle bracket spacers first and second ends arranged such that the axle bracket spacer first end is adjacent to an axle cap and the axle bracket spacer second end is adjacent to an axle bracket exterior side wherein the axle bracket spacer retains the bungee tube in axial alignment with the tubular axle.

7. The storage apparatus for fastening devices as in claim 3 further comprising:

a. one or more axle brackets with an interior side, an exterior side, and a continuous opening between the interior and exterior sides such that the opening forms an axle bracket bearing surface, the axle bracket arranged within the bungee tube end openings such that the axle bracket is connected to the bungee tube interior surface;

b. a tubular axle with a first end and a second end arranged such that the tubular axle may be inserted through the axle bracket bearing surface such that the axle bracket bearing surface may be rotated about the tubular axle wherein the connected bungee tube is also rotated about the tubular axle;

c. two axle bracket spacers with a first end and a second end and an inner surface and an outer surface, the ends containing an end opening continuous from the first end to the second end, the openings arranged such that the tubular axle may be inserted into the opening;

d. two axle caps with an attachment end and a closed end, the attachment end with an internal opening from the attachment end partially to the hanger end and arranged such that the tubular axle may be inserted in the attachment end internal opening, the attachment end further arranged with means for fastening the axle cap to the inserted tubular axle; and e. the axle bracket spacers first and second ends arranged such that the axle bracket spacer first end is adjacent to an axle cap and the axle bracket spacer second end is adjacent to an axle bracket exterior side wherein the axle bracket spacer retains the bungee tube in axial alignment with the tubular axle.

8. The storage apparatus for fastening devices as in claim 4 further comprising:

a. one or more axle brackets with an interior side, an exterior side, and a continuous opening between the interior and exterior sides such that the opening forms an axle bracket bearing surface, the axle bracket arranged within the bungee tube end openings such that the axle bracket is connected to the bungee tube interior surface;

b. a tubular axle with a first end and a second end arranged such that the tubular axle may be inserted through the axle bracket bearing surface such that the axle bracket bearing surface may be rotated about the tubular axle wherein the connected bungee tube is also rotated about the tubular axle;

c. two axle bracket spacers with a first end and a second end and an inner surface and an outer surface, the ends containing an end opening continuous from the first end to the second end, the openings arranged such that the tubular axle may be inserted into the opening;

d. two axle caps with an attachment end and a closed end, the attachment end with an internal opening from the attachment end partially to the hanger end and arranged such that the tubular axle may be inserted in the attachment end internal opening, the attachment end further arranged with means for fastening the axle cap to the inserted tubular axle; and e. the axle bracket spacers first and second ends arranged such that the axle bracket spacer first end is adjacent to an axle cap and the axle bracket spacer second end is adjacent to an axle bracket exterior side wherein the axle bracket spacer retains the bungee tube in axial alignment with the tubular axle.

9. The storage apparatus for fastening devices as in claim 5 further comprising the axle cap closed end is arranged with means for hanging the storage apparatus by the axle cap.

10. The storage apparatus for fastening devices as in claim 6 further comprising the axle cap closed end is arranged with means for hanging the storage apparatus by the axle cap.

11. The storage apparatus for fastening devices as in claim 7 further comprising the axle cap closed end is arranged with means for hanging the storage apparatus by the axle cap.

12. The storage apparatus for fastening devices as in claim 8 further comprising the axle cap closed end is arranged with means for hanging the storage apparatus by the axle cap.

13. The storage apparatus for fastening devices as in claim 5 further comprising a vertical mounting stand with a mounting end and a support end, the mounting end arranged with an opening such that one end of the tubular axle may be inserted in the opening, the support end arranged such that the storage apparatus may be positioned in an orientation determined by the stand location.

14. The storage apparatus for fastening devices as in claim 6 further comprising a vertical mounting stand with a mounting end and a support end, the mounting end arranged with an opening such that one end of the tubular axle may be inserted in the opening, the support end arranged such that the storage apparatus may be positioned in an orientation determined by the stand location.

15. The storage apparatus for fastening devices as in claim 7 further comprising a vertical mounting stand with a mounting end and a support end, the mounting end arranged with an opening such that one end of the tubular axle may be inserted in the opening, the support end arranged such that the storage apparatus may be positioned in an orientation determined by the stand location.

16. The storage apparatus for fastening devices as in claim 8 further comprising a vertical mounting stand with a mounting end and a support end, the mounting end arranged with an opening such that one end of the tubular axle may be inserted in the opening, the support end arranged such that the storage apparatus may be positioned in an orientation determined by the stand location.

17. A storage apparatus for elastic fastening devices comprising:

a. means for storing multiple fastening devices arranged in a cylindrical configuration;

b. means for identifying, attaching, and removing fastening devices of varying length; and c. means for rotating the apparatus wherein all the stored fastening devices may be viewed and retrieved.

18. The storage apparatus for fastening devices as in claim 17 further comprising means for positioning the apparatus in a horizontal position.

19. The storage apparatus for fastening devices as in claim 17 further comprising means for positioning the apparatus in a vertical position.

20. A method of manufacturing a storage apparatus for elastic fastening devices comprising:

a. selecting a bungee tube that is rotated by turning the tube by hand whereas the entire circumference of the tube is visible and accessible with a first end and a second end of a length such that a multiplicity of the longest elastic fastening devices may be attached between the bungee tube ends; and b. forming a multiplicity of attachment openings in the bungee tube such that a multiplicity of elastic fastening devices of a multiplicity of lengths shorter than the longest elastic fastening devices may be attached between attachment openings and between an attachment opening and a bungee tube end;

c. forming a multiplicity of bungee tube end notches such that the notches restrict movement of the fastening device on the bungee tube outer surface circumference.

21. The method of manufacturing a storage apparatus for elastic fastening devices as in claim 20 further comprising forming a multiplicity of attachment opening notches such that the notches restrict movement of the fastening device on the bungee tube outer surface circumference.

22. The method of manufacturing a storage apparatus for elastic fastening devices as in claim 20 further comprising forming a multiplicity of attachment opening notches such that the notches restrict movement of the fastening device on the bungee tube outer surface circumference.

23. The method of manufacturing a storage apparatus for elastic fastening devices as in claim 20 further comprising mounting the bungee tube on a multiplicity of axle brackets such that the axle brackets rotate on an axle.

24. The method of manufacturing a storage apparatus for elastic fastening devices as in claim 23 further comprising installing axle caps on each end of the axle such that the device may be horizontally supported by the axle caps.

25. The method of manufacturing a storage apparatus for elastic fastening devices as in claim 24 further comprising installing a mounting stand on one axle end such that the device may be supported by the mounting stand.

26. A storage and retrieval method for elastic fastening devices with end attachment means comprising:

a. choosing a storage location on a cylindrical bungee tube exterior surface containing a multiplicity of attachment openings to accommodate the fastening device length and engaging the end attachment means with the bungee tube exterior surface attachment openings;

b. repeating step a. such that a multitude of elastic fastening devices of varying lengths are stored by the end attachment means between two attachment openings, between an attachment opening and a bungee tube end, and between the bungee tube ends;

c. retrieving an elastic fastening device of desired length by;

d. rotating the bungee tube such that the fastening device lengths may be inspected;

e. identifying a desired fastening device length; and f. removing the desired fastening device from the cylindrical bungee tube such that the end attachment means are disengaged from the bungee tube.

* * * * *